US006655243B2

(12) United States Patent
Anderson et al.

(10) Patent No.: US 6,655,243 B2
(45) Date of Patent: Dec. 2, 2003

(54) MULTIPLE-IN-1 PRECISION HAND TOOL

(76) Inventors: Wayne Anderson, 65 Groove St., Northport, NY (US) 11768; Paolo Cassutti, 8 North Creek Rd., Northport, NY (US) 11768

( * ) Notice: Subject to any disclaimer, the term of this patent is extended or adjusted under 35 U.S.C. 154(b) by 94 days.

(21) Appl. No.: 10/000,926

(22) Filed: Oct. 19, 2001

(65) Prior Publication Data

US 2002/0035901 A1 Mar. 28, 2002

Related U.S. Application Data

(63) Continuation-in-part of application No. 09/504,190, filed on Feb. 15, 2000, which is a continuation-in-part of application No. 09/435,709, filed on Nov. 8, 1999, now Pat. No. 6,374,711, which is a continuation-in-part of application No. 09/168,637, filed on Oct. 8, 1998, now Pat. No. 6,209,428, and a continuation-in-part of application No. 08/977,453, filed on Nov. 24, 1997, now Pat. No. 5,904,080, which is a continuation-in-part of application No. 08/960,090, filed on Oct. 24, 1997, now Pat. No. 5,819,612, which is a continuation-in-part of application No. 08/690,740, filed on Jul. 31, 1996, now Pat. No. 6,105,474.

(51) Int. Cl.[7] ..... B25G 1/00
(52) U.S. Cl. ..... 81/490; 81/177.2; 81/438
(58) Field of Search ..... 81/177.2, 438, 81/439, 451; 7/165

(56) References Cited

U.S. PATENT DOCUMENTS 2,230,381 A * 2/1941 Jorgensen ..... 81/438
2,592,978 A * 4/1952 Trimboli ..... 81/177.2
2,822,714 A * 2/1958 Paparelli ..... 81/439
2,842,020 A * 7/1958 Tarquinio ..... 81/177.2
4,227,430 A 10/1980 Jansson et al.
4,703,677 A * 11/1987 Rossini ..... 81/471
5,174,178 A 12/1992 Disston, Jr.
5,309,798 A * 5/1994 Markwart et al. ..... 81/438
5,613,413 A * 3/1997 Huang ..... 81/490
5,662,013 A 9/1997 Lin
5,740,706 A 4/1998 Tseng
5,782,150 A 7/1998 Huang
5,794,497 A * 8/1998 Anderson ..... 81/451
5,823,078 A 10/1998 Liu
5,931,065 A * 8/1999 Jackson et al. ..... 81/177.2
D419,847 S 2/2000 Chen
6,026,718 A * 2/2000 Anderson ..... 81/451
6,029,549 A * 2/2000 Baker ..... 81/439
6,089,133 A * 7/2000 Liao ..... 81/438
6,155,144 A * 12/2000 Lin ..... 81/438
6,220,129 B1 * 4/2001 Shimansky ..... 81/490
D444,047 S 6/2001 Chen
6,305,256 B1 * 10/2001 Anderson et al. ..... 81/490

* cited by examiner

*Primary Examiner*—James G. Smith
(74) *Attorney, Agent, or Firm*—Lackenbach Siegel LLP

(57) ABSTRACT

A 12-in-1 precision hand tool has five double-ended specifically sized precision tool bits stored in separate handle compartments adjacent the handle proximate end and one double-ended tool bit operably disposed at the distal end of a selectively retractably extendible shank for impeded access precision drive use. A handle cap is removably attached to the handle and has a rare earth permanent metal magnet disposed therein and operably disposed with respect to an axial opening in the cap to slidably receive and magnetically hold one selected double-headed tool bit. The removed handle cap provides a mini 12-in-1 precision drive tool. The handle has alternate flat and arcuate surfaces of about equal surface area and distally disposed contiguous tapered flat surfaces for ergonomic precision tool use.

28 Claims, 12 Drawing Sheets

MULTIPLE-IN-1 PRECISION HAND TOOL

PRIOR RELATED APPLICATIONS

This application is a continuation-in-part of U.S. Ser. No. 09/435,709 filed Nov. 8, 1999, now U.S. Pat. No. 6,374,711, which is a continuation-in-part of U.S. Ser. No. 09/168,637, filed Oct. 8, 1998, now U.S. Pat. No. 6,209,428, which is a continuation-in-part of U.S. Ser. No. 08/960,090, filed Oct. 24, 1997, now U.S. Pat. No. 5,819,612, and a continuation-in-part of U.S. Ser. No. 08/977,453, filed Nov. 24, 1997, now U.S. Pat. No. 5,904,080, and a continuation-in-part of U.S. Ser. No. 09/504,190, filed Feb. 15, 2000, which is a continuation-in-part of U.S. Ser. No. 08/690,740, filed Jul. 31, 1996, now U.S. Pat. No. 6,105,474.

FIELD OF INVENTION

This invention relates to precision hand tools. This invention more specifically relates to multiple-in-1 precision hand drive tools, and precision tool bits therefor. This invention also relates to ergonomic handle precision drive tools. This invention also specifically relates to combination multiple-in-1 precision hand tools.

BACKGROUND AND DISCUSSION OF THE PRIOR ART

Precision hand tools or drivers are known in the art wherein the user engages the body of the tool handle with the thumb and middle finger and the index finger pressingly engages the proximate end of the handle. Fine rotational movement is achieved by the thumb and middle finger imparting a finely controlled torque movement to the handle body and in turn to the distally disposed tool bit.

It was known in the prior art to provide precision hand tool sets wherein the tool and interchangeable single-ended precision tool bits were stored in a case. Such prior art sets are shown in FIGS. 1A and 1B. FIGS. 1A and 1B depict a prior art precision tool set 10 wherein a case 15 contained the precision hand tool 11 and a number of interchangeable single-ended precision tool bits 12. The single-ended tool bits 12 were individually stored in case 15, and selectively slidably operably disposed at the distal end 16 of hand tool 11. These sets were undesirable in that the user had to carry and access the case 15 at and to the work site. The small single-ended precision tool bits when removed from the case would be readily lost or misplaced.

FIG. 2 depicts another prior art precision hand tool set 13, wherein a series of precision screwdrivers 17–24 were stored in the case 29 with different tool bit configurations formed at the respective ends of the fixedly disposed shanks. Tool set 13 was bulky and cumbersome in use, and only a limited number of drive functions were practically available. Additionally, the user had to access the bulky case and tool set at the work site.

It was also known in the prior art to provide a precision hand tool wherein interchangeable precision single-ended tool bits were loosely stored in the handle. Such hand tools are shown in FIGS. 3A and 3B. Specifically, FIGS. 3A and 3B depict a precision hand tool 25 wherein a number of elongated single ended tool bits 26 (typical) were loosely stored in the hollow handle 27. The user would remove end cap 28 and shake out the tool bits and then insert the desired selected tool bit in the distal end 29 of tool 25. The FIGS. 3A and 3B hand tool was undesirable in that the small precision tool bits would be damaged in loose common storage, and it was difficult to selectively retrieve just the desired tool bit without misplacing the other tool bits. The prior art tool of FIGS. 3A and 3B also suffered the impediment of requiring a large number of single-ended bits to accomplish an equally large number of drive functions. The precision size handle could not however accommodate a sufficient number of such bits.

FIGS. 4A and 4B depict still another prior art precision tool set 30. Tool set 30 contains a precision hand tool 31 with a flexible shaft 32, a sleeve 32*a* and, generally six single-ended tool bits 33 (typical). The single-ended tool bits 33 were mounted in a case 34. Sleeve 32*a* was slidably received over flexible shaft 32 to, alternately, use the tool as a non-flexible shaft tool. Each tool bit 33 was slidably non-rotatably operably disposed in the distal end 36 of hand tool 31. Set 30 required a case 34 for storage and the removed loose tool bits 33 would be readily lost or misplaced.

The prior art was generally directed to highly elongated single-ended precision tool bits. These tool bits were formed from wire blanks of exceptional length. FIG. 16 shows a typical prior art single-ended precision tool bit. It was believed that the exceptional length was required to achieve an accurately machined precision tool bit ends. These exceptional length precision tool bits militated against stowage in precision sized hand tool handles.

The prior art, as demonstrated in FIGS. 1–4B and 16 was directed to providing single-ended precision tool bits. The prior art, as shown in FIGS. 2–4B and 16 was instead directed to precision single-ended tool bits with exceptionally elongated body portions.

It was also known in the hand tool art to provide magnetic functions in the hand tool handle. This prior art construction would temporarily magnetize and demagnetize a selected tool bit end. The art desired a versatile and practical magnet and functionality in precision hand tools.

The art desired a practical multiple function, multiple-in-1 precision drive tool. The precision tool art also described an ergonomic precision drive tool handle. The present invention provides the solutions to the foregoing art desired needs.

SUMMARY OF INVENTION

In one aspect, the present invention is a multiple-in-1 precision hand tool. In another aspect, the present invention is a precision hand tool with a 12-in-1 drive function. The precision tool, in other preferred aspects, has a mag/demag function and a removable handle cap mini multiple-in-1 tool bit drive function.

In a more specific aspect, the present invention is a precision hand tool, with a removable cap disposed at the proximate end, which cap magnetically operably holds a tool bit so that the tool bit is operably disposed in the handle cap. The handle cap with the magnetically held tool bit functions as a mini fine control screwdriver.

In still another aspect, the present invention is a precision hand tool with double-ended or double-headed precision-sized tool bits. The precision double-ended tool bits are practically stored within elongated compartments of the precision-sized hand tool handle.

The precision double-ended tool bits of the present invention are specifically proportioned with each bit end and central body being of the same length, and within a practical overall minimal length. The limited overall length made it possible to store a plurality of such double-ended bits in the handle of a precision sized hand tool. The tool bits are alternatively operably received in the precision handle cap and at the distal end of the precision hand tool shank for alternate drive use.

In still further aspects, the present invention is a precision hand tool with ergonomic handle construction.

It is still a further aspect, the present invention provides a handle as aforesaid in combination with an extendible metal shank for diverse precision tool operations. The handle and hexagonal shank construction of the present invention provide for the proximate end of the shank and the internal hexagonal sleeve to provide stop means to hold the shank in the handle. The spatial arrangement and construction of the proximate end of the shank and the distal end of the handle wherein forces caused by flexure of the fully extended sleeve are distributed to prevent fracture of the handle.

In still further aspects, the present invention contemplates a hand tool which combines one or more of the aforedescribed inventive features of the present invention.

DESCRIPTION OF THE PREFERRED EMBODIMENT

Figure 1A:
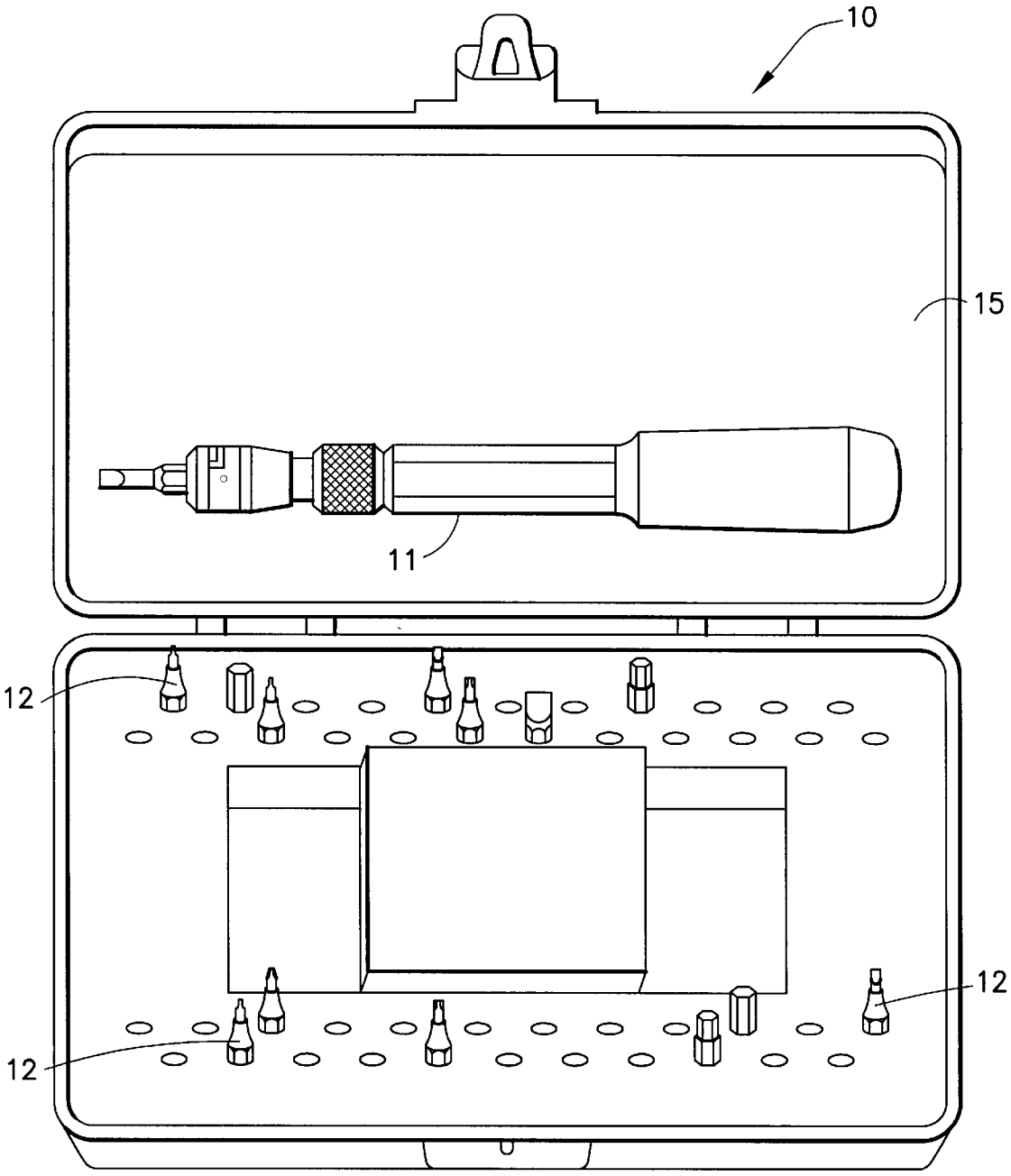
FIG. 1A PRIOR ART
FIG. 1A is a front elevational view of a prior art precision hand tool set in its carrying case.
Figure 1B:
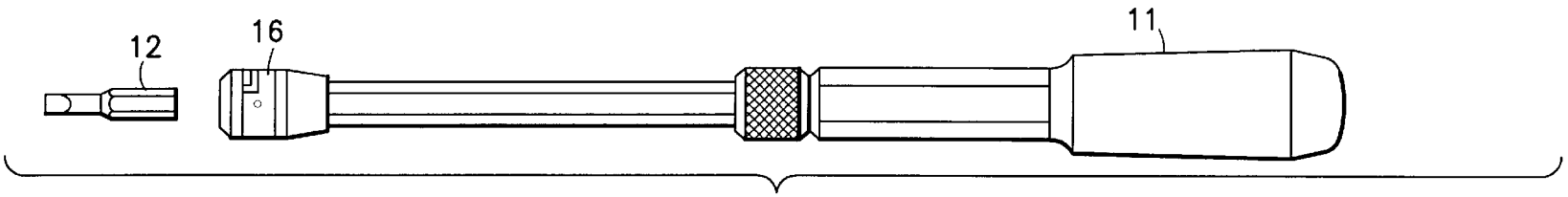
FIG. 1B is a side elevational view of the precision hand tool of the set of FIG. 1A.
Figure 3A:
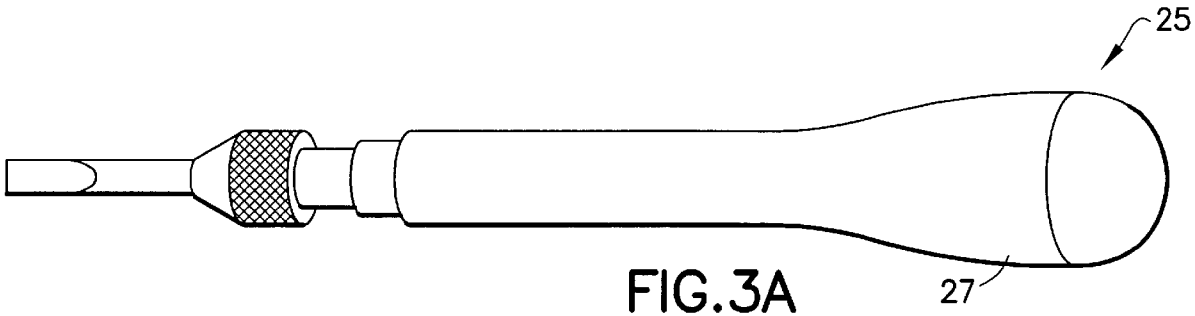
FIG. 3A PRIOR ART
FIG. 3A is a side elevational view of a third prior art precision hand tool.
Figure 3B:
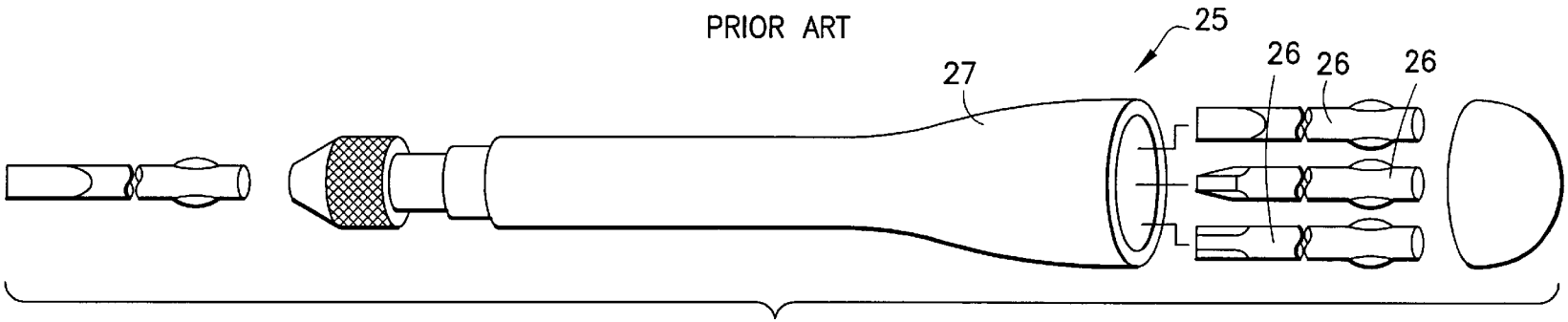
FIG. 3B PRIOR ART
FIG. 3B is an exploded side view of the precision hand tool of FIG. 3A.
Figure 2:
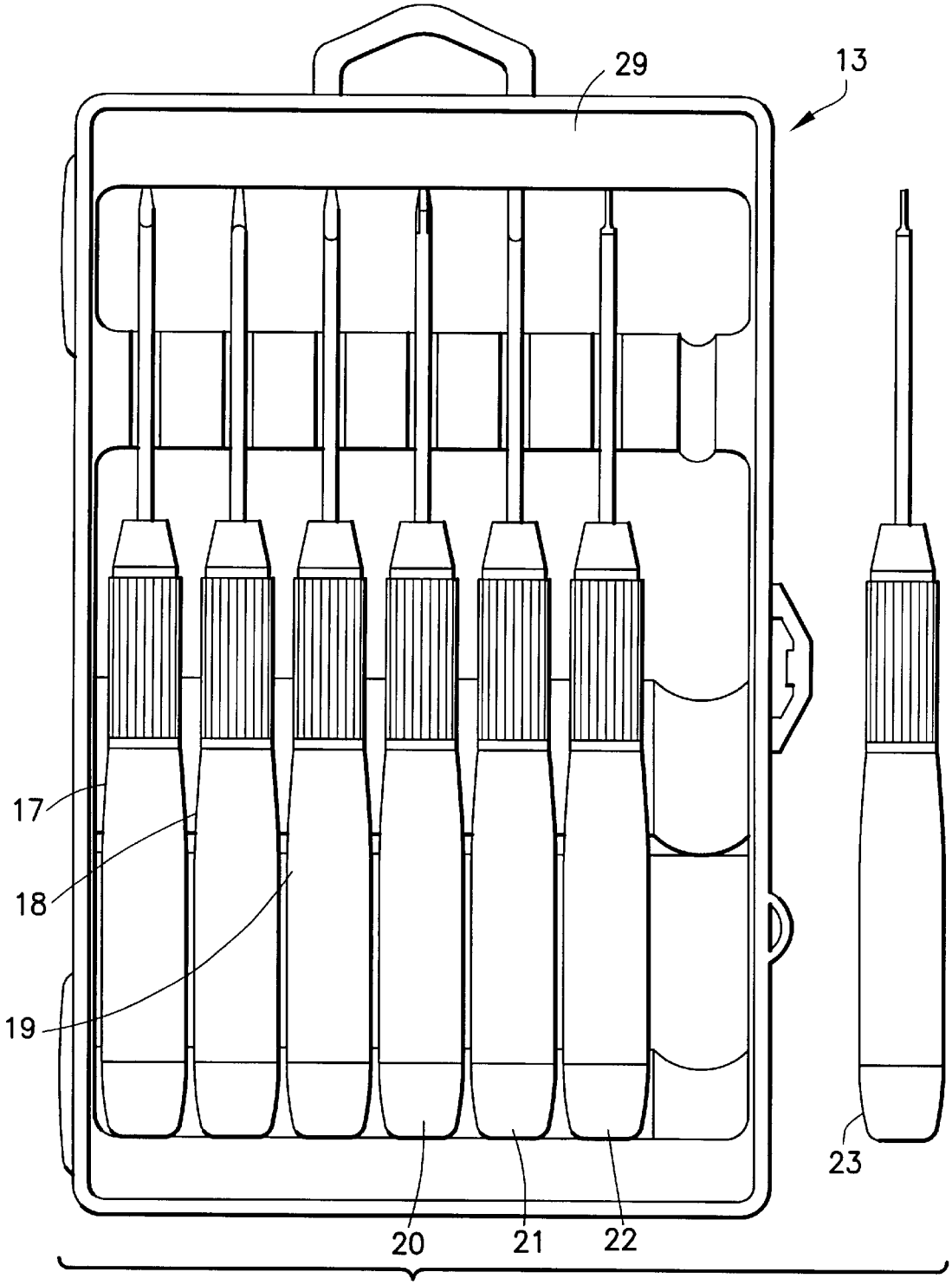
FIG.2 PRIOR ART
FIG. 2 is a front elevational view of a second prior art precision hand tool set in its case and with one precision hand tool removed.
Figure 4A:
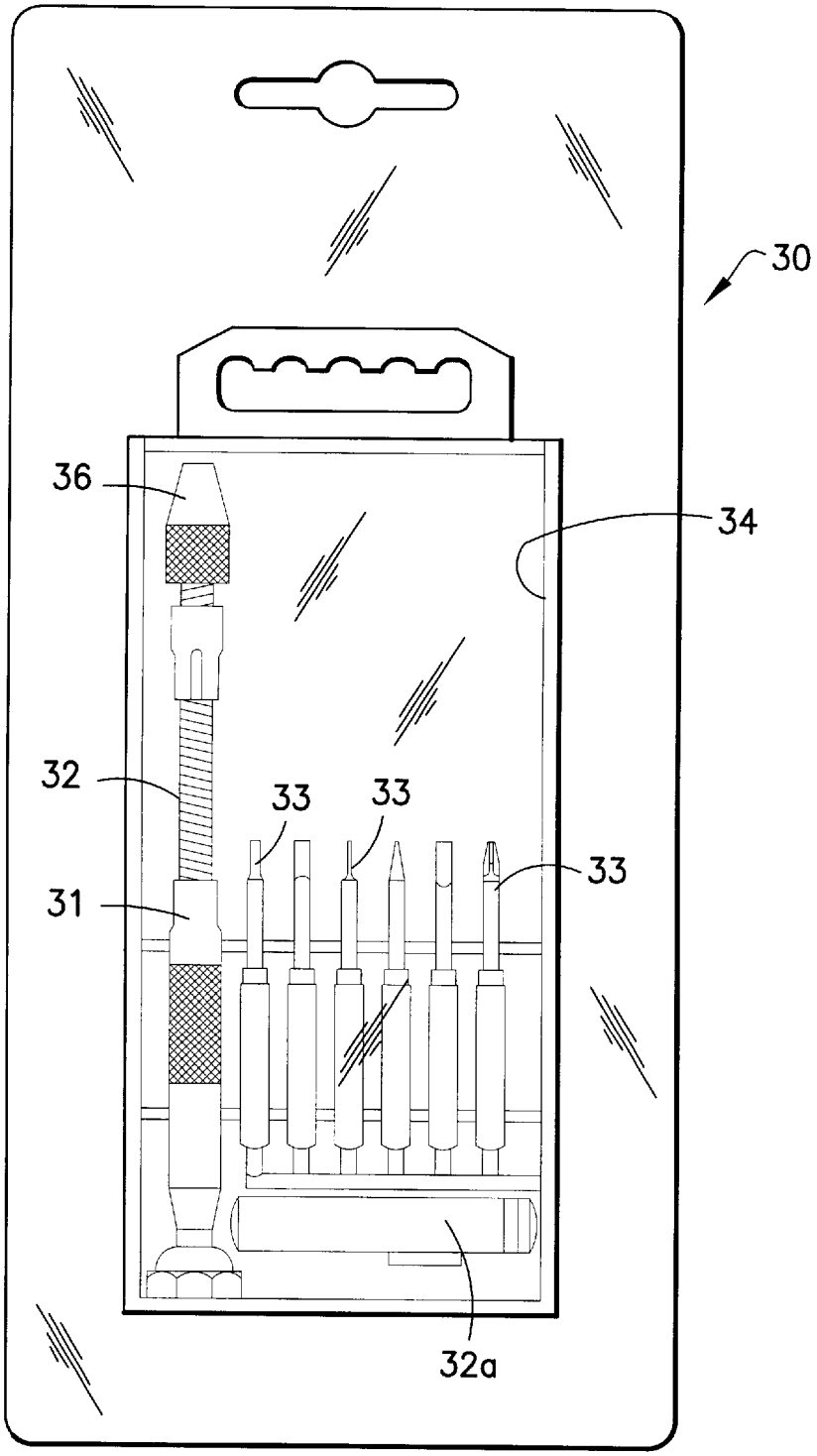
FIG.4A PRIOR ART
FIG. 4A is a front elevational view of a fourth prior art precision hand tool set in its case mounted on a display card.
Figure 4B:
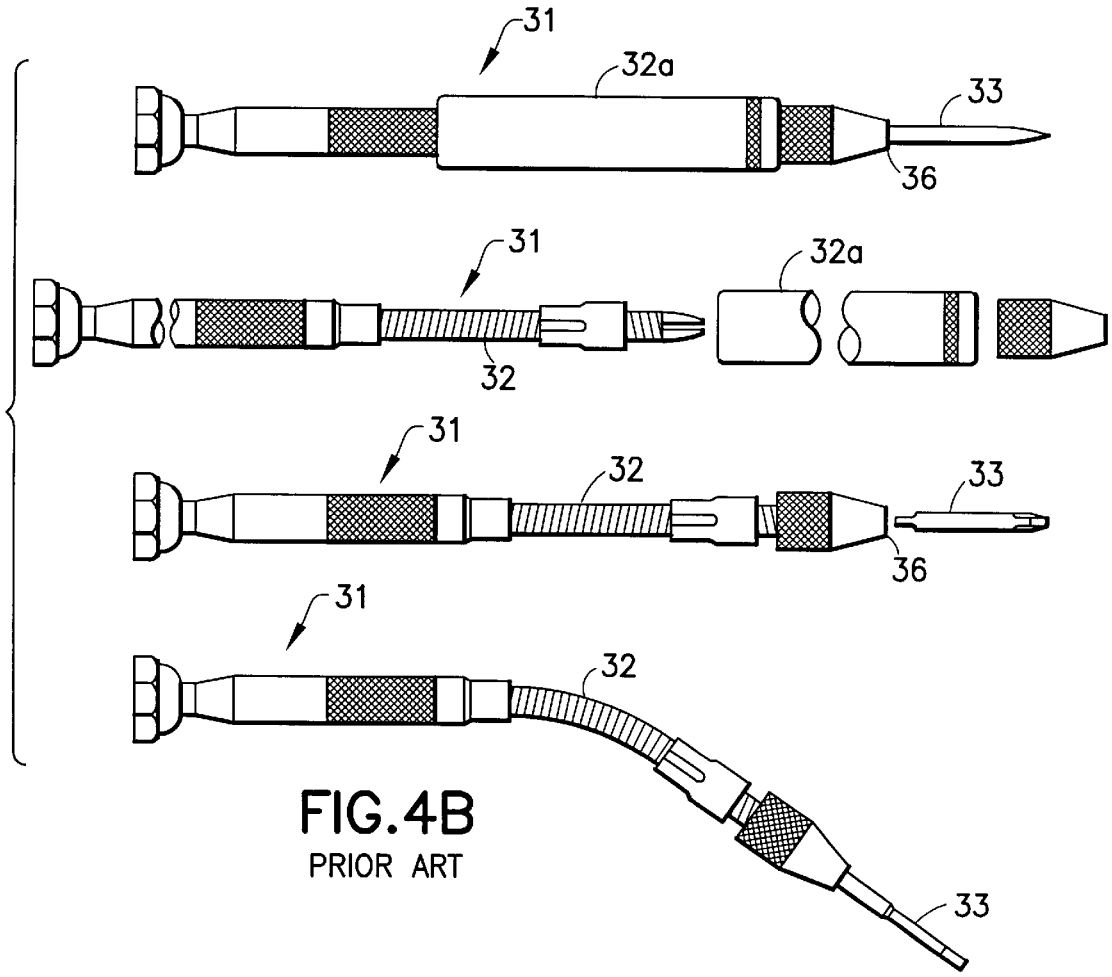
FIG.4B PRIOR ART
FIG. 4B is a series of side elevational views of the precision hand tool removed from the set of FIG. 4A in various non-flexed and flexed shaft modes.
Figure 5:
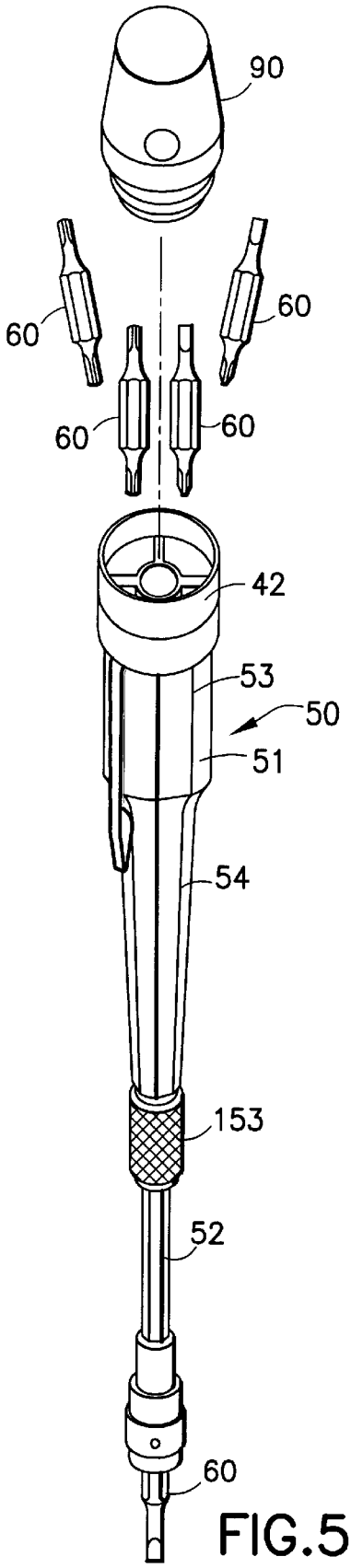
FIG. 5 is a exploded top perspective view of the precision hand tool of the present invention.
Figure 6:
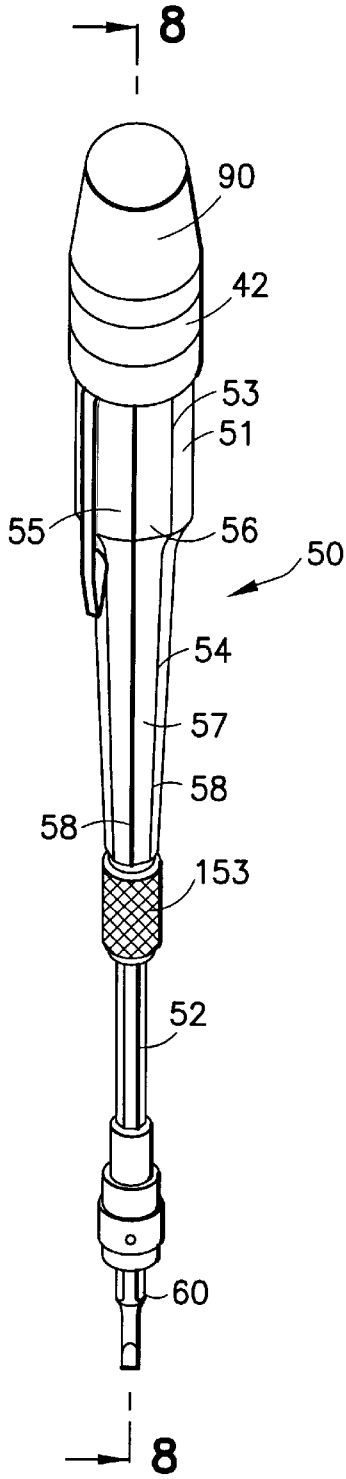
FIG. 6 is a top perspective view of the assembled precision hand tool of FIG. 5 with the tool bit operably disposed and shank retracted.
Figure 7:
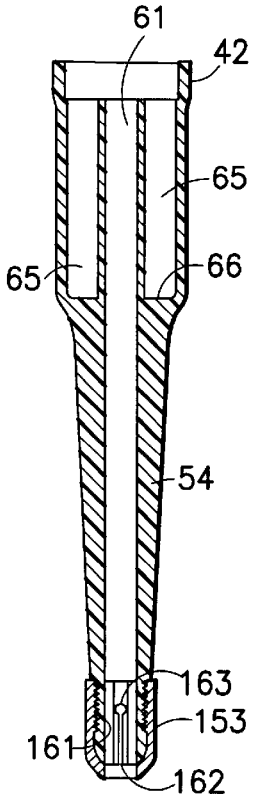
FIG. 7 is of a sectional view of handle of FIG. 6 without the shank.
Figure 8:
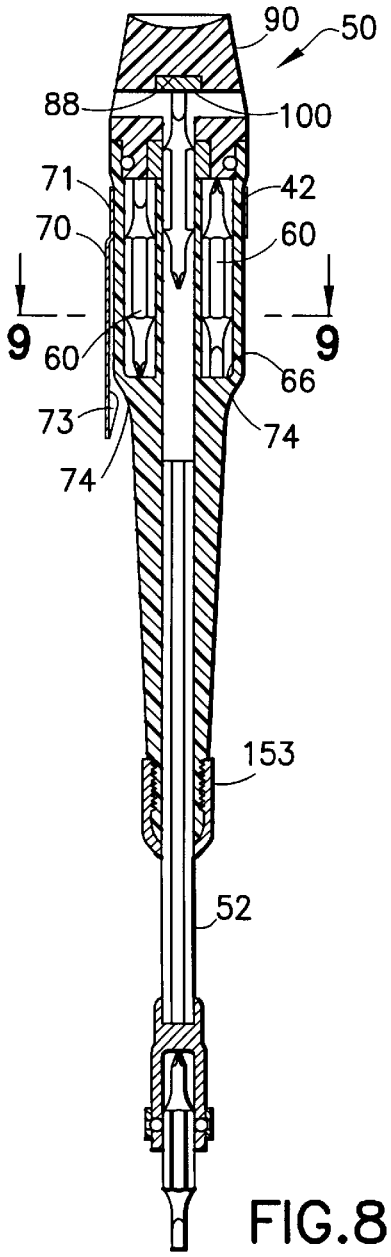
FIG. 8 is a sectional view of the precision hand tool taken along line 8—8 of FIG. 6.
Figure 9:
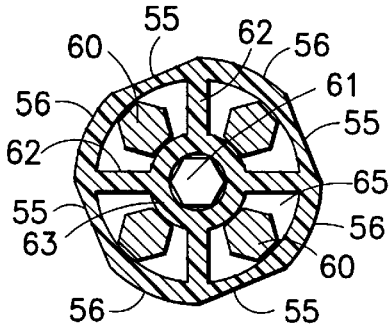
FIG. 9 is an enlarged sectional view taken along line 9—9 of FIG. 8.
Figure 10:
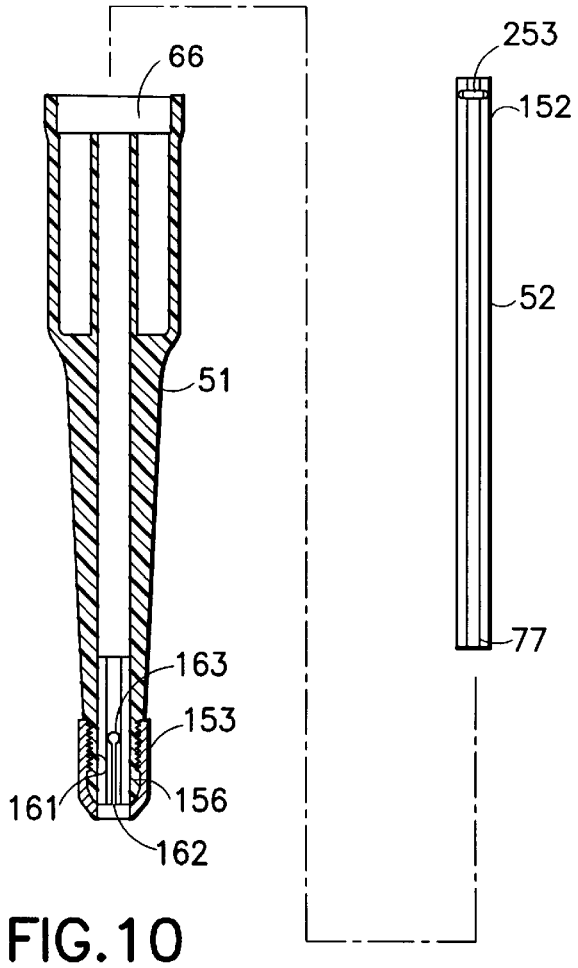
FIG. 10 is a sectional view of the handle of the handle and a side elevational assembly view of a shank.

Referring to FIGS. 5–15 and 18–22 there is shown precision hand tool 50. Precision hand tool 50, in general terms, includes removable handle cap 90, transparent plastic handle or handle body 51, hexagonal cross-sectioned metal shank 52, shank lock nut 53, distally disposed sleeve assembly 57 and six double-ended precision tool bits 60 (typical). The six double-ended tool bits 60 provide a 12-in-1 drive functionality. Handle 51 is of clear thermoplastic construction. Handle 51 includes a proximately disposed circular cylindrical portion 42, a first body portion 53, and a second body portion 54. First body portion 53 has four equally sized flat walls 55 (typical) and four equally sized curved or arcuate walls 56(typical). Walls 55 and 56 have about the same surface area (See FIGS. 6 and 9). Second body portion 54 has eight distally tapered flat walls 57(typical) and eight corners 58(typical). Each second portion wall 57 is contiguous with one of the first portion walls 55 or 56 as at common recess 74. First and second body portions 53 and 54 are formed with a central axially disposed cylindrical hole 61, and distal end of body portion 54 is formed with central hexagonal hole 161 for purposes hereinafter appearing. First body portion 53 is formed with four radially disposed walls 62, and central cylindrical wall 63 which in turn forms four wedge shaped recesses or compartments 65 having distal end walls 66. Each compartment 65 slidably receives or stows a respective double-ended tool bit 60.

Figure 14:
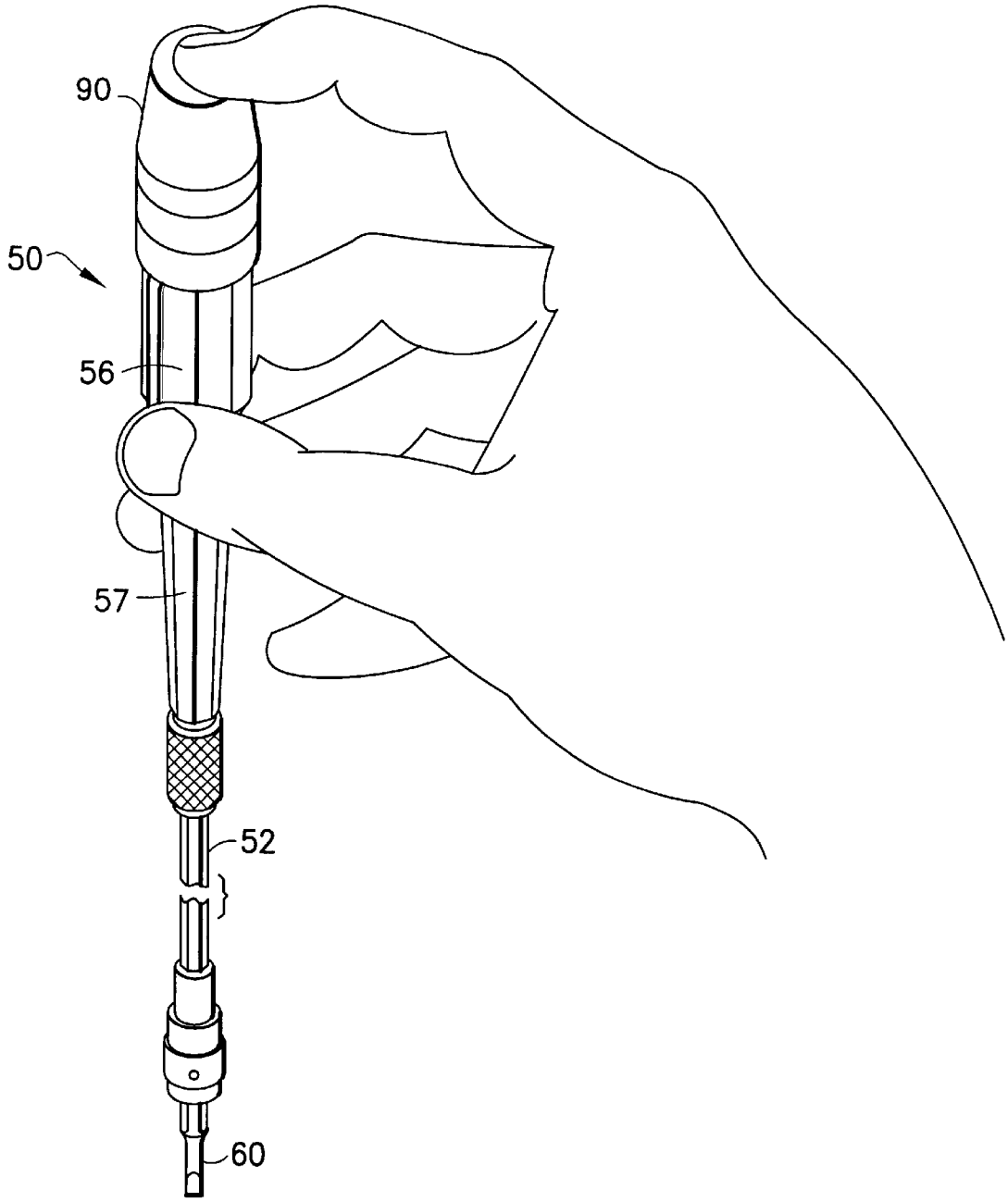
FIG. 14 is a perspective view of the precision tool of FIG. 12 in one mode of use.
Figure 15:
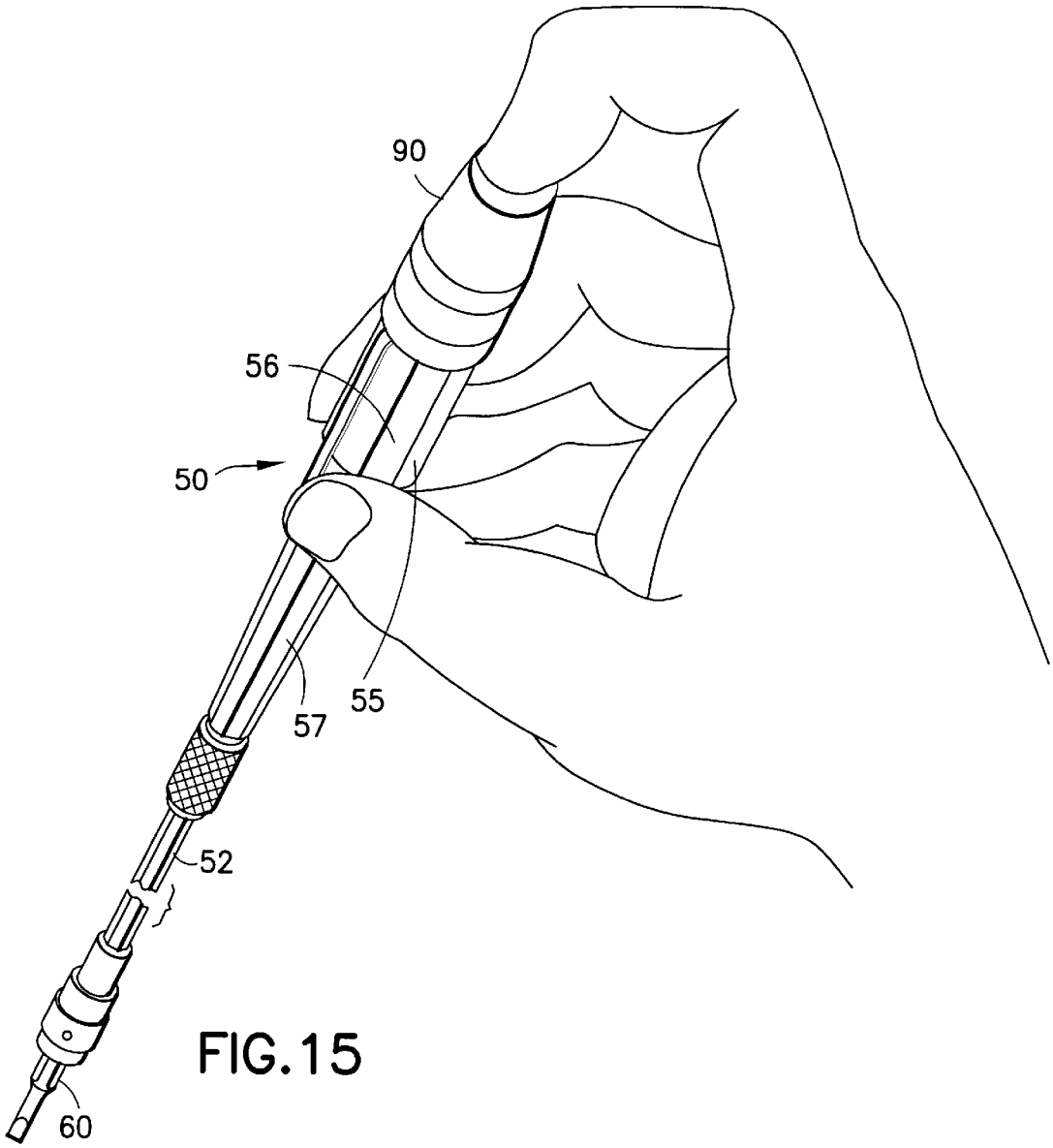
FIG. 15 is a perspective view of the precision tool of FIG. 12 in a second mode of use.

First body portion 53 and second body portion 54 provide an ergonomic handle construction, wherein the user can selectively in diverse combinations grip the flat walls 55, arcuate walls 56 tapered walls 57 for best desired comfort and control. By way of example, with the shank fully extended, the user may want particularly fine control. The walls 55, 56, and 57 provide diverse ergonomic grip arrangements for diverse fine precision drive operations. Two such grip examples are shown in FIGS. 14 and 15, respectively.

A metal pocket clip 70 has a cylindrical holder portion 71 which is slidably received on the outer cylindrical surface of handle proximate portion 42 Pocket clip 70 includes pocket engaging portion 72, which extends distally to wherein clip end 73 is disposed adjacent corner recess 74.

Figure 11:
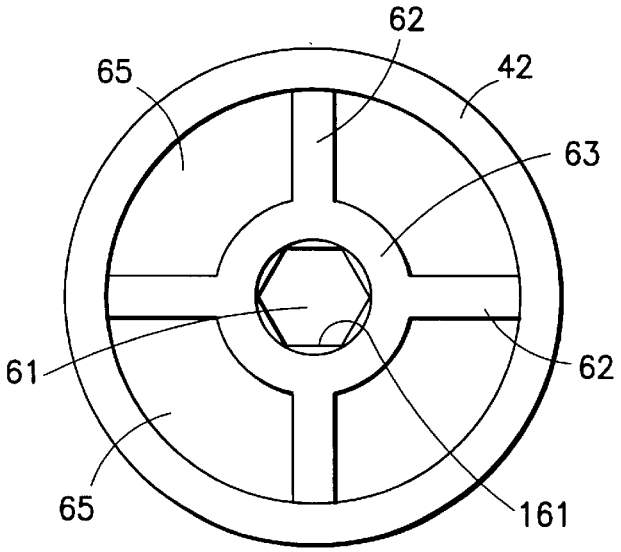
FIG. 11 is an enlarged view of the proximate end of the handle of FIG. 10.
Figure 12:
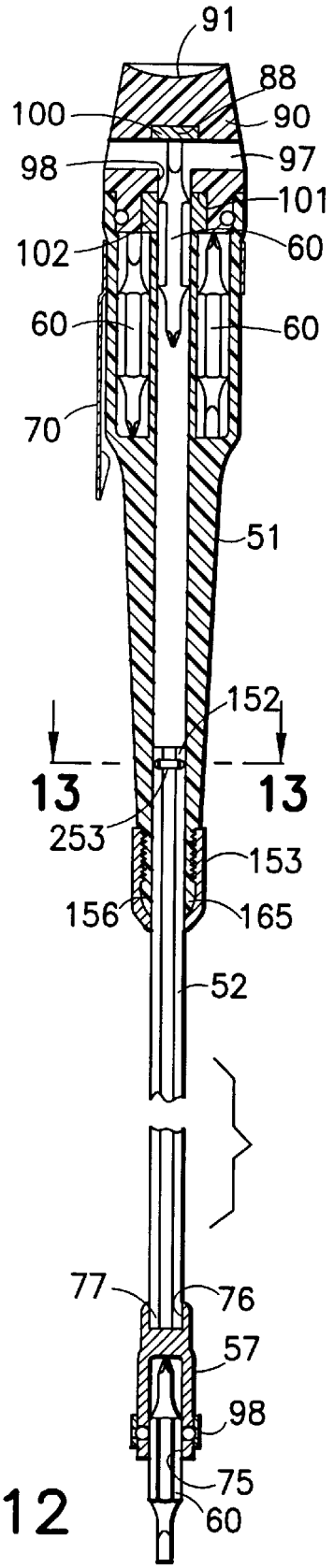
FIG. 12 is a sectional view of the assembled tool of FIG. 5 with the shank fully extended.
Figure 13:
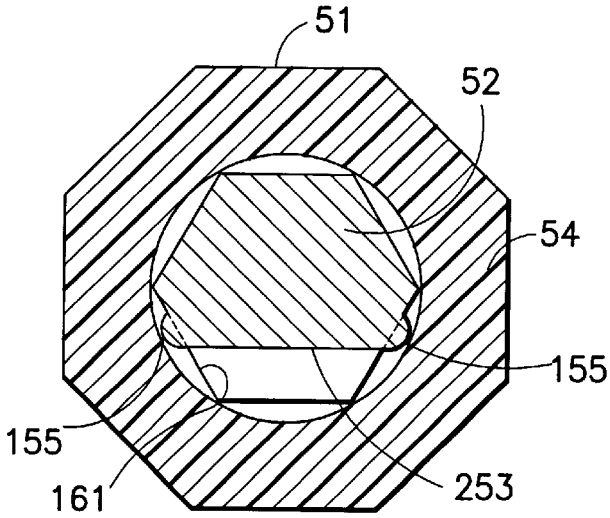
FIG. 13 is a greatly enlarged sectional view taken along line 13—13 of FIG. 12.

Shank 52 is slidably disposed in proximately disposed central axially disposed cylindrical hole 61 and distally disposed hexagonal hole 161, whereby shank 52 can be slidably extended for precision drive use in impeded access operations such as electronics equipment. Lock nut assembly 153 locks the extended shank 52 in the extended desired position. Referring specifically to FIGS. 10–13, there is shown certain details of tool 50 with regard to the lower or distal body portion 54 and the proximate end 152 of shank 52. Shank proximate end 152 is formed with a transverse groove 253 and oppositely disposed ears 155. Ears 155 frictionally engage the corners of hexagonal hole 161 and thereby functions as a stop to retain the shank 52 within the plastic handle body. Sleeve portion 161 is formed with a vertically disposed slot 162 having an enlarged rounded stress relief blind edge 163. In molding the handle, shank 52 is slidably received in the distal end hole 61 of handle 51, when the thermoplastic body is just molded and readily thermoplastically deformable. The shank 52 is then moved distally to cover the ears 155 to gouge the thermoplastically deformable walls of hexagonal recess of sleeve 161 and in doing so form a stop. In operation, shank 52 slides freely through central cylindrical hole 61, until the ears 155 engage the corners of hole 161. That is, shank end 152 engages the proximate end hexagonal sleeve portion 161 to stop further movement. When shank 52 is fully extended, as shown in FIGS. 12 and 13, shank ears 155 frictionally engage two corner walls of hexagonal sleeve portion 161 and exert radial forces on the plastic sleeve. Slot 162 and slot end 163 relieve the radial force stress to avoid fractures in the plastic handle. In this manner of construction, frictionally engaged shank 52 is prevented from sliding out the distal end 156 of handle 51. Lock nut 153 screw engages the distal end 165 of handle 51 so that with the fastening of lock nut 153, shank 52 is fixed in its extended position. The shank distal end 152 portion disposed hexagonal sleeve end portion 161 spatial arrangement and construction distribute the bending forces caused by extended shank flexure thereby presenting plastic handle fracture.

Sleeve assembly 57 includes a distal hexagonal recess 75 for slidably non-rotatably operably receiving a tool bit 60. Sleeve assembly 57 is also formed with a proximately disposed hexagonal recess 76 for fixedly non-rotatably receiving the distal end 77 of hexagonal shank 52. Sleeve assembly 57 is also formed with a lock collar and ball retainer assembly 78 for holding tool bit 60 in place in sleeve recess 75. With tool bit 60 removed, sleeve assembly hexagonal end recess 76 serves as a precision nut driver.

Handle cap 90 is formed with a proximately disposed slight depression or recessed surface 91 for receiving the end of the user's index finger. Cap 90 has a fustro-conical body 92. Handle cap 90 has a cylindrical distal end portion 93 formed with a circumferential groove 191 for receiving a snap-on O-ring. Cap distal portion 93 is slidably received in the proximate end recess 66 of handle 51, and removably held therein by the O-ring in handle body circumferential groove. Attached cap 90 swivels in handle body recess 66. Cap 90 covers the four tool bits 60 stowed in the elongated arcuate handle compartments 65.

Handle cap 90 is formed with a transversely disposed cross-hole 97, and an axially disposed cylindrical recess 98 which communicates with cross-hole 97. A cylindrical or pill shaped rare earth permanent magnet 100 is secured in recess 88 by known means, for purposes hereinafter appearing. Cap 90 is also formed with a distal end stepped recess 101 for non-rotatably receiving metal insert 102. Insert 102 is formed with a hexagonal inner bore 103 which is sized to slidably receive the body 60*a* of double-ended precision tool bit 60 typical. Handle cap and metal insert hexagonal bore 103 function as a mini nut drive tool with cap 90 detached from the handle body and with tool bit removed. With tool bit 60 disposed in bore 103, one tool bit end 60*b* contactingly engages magnet 100 and the other tool bit end 60*b* is operably disposed, as best shown in FIGS. 14–17. Magnet 100 magnetically holds tool bit 60 in cap 90. Distally disposed tool bit end 60*b* is magnetized to magnetically hold a fastener such as a screw (not shown). In this manner of construction, handle removed cap 90 with tool bit 60 magnetically held functions as a mini precision screwdriver. Of course, any one of the six tool bits can be selectively magnetically held and operably disposed in removed handle cap 90.

Figure 19:
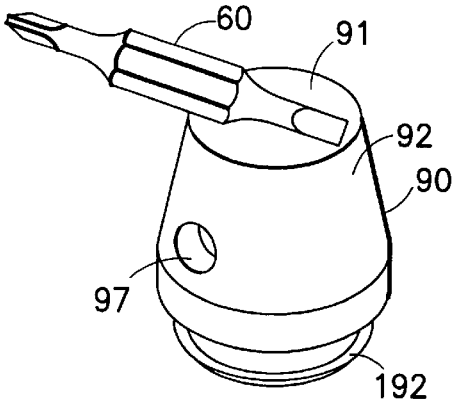
FIG. 19 is a perspective view of the handle cap of FIG. 5 with a tool bit being demagnetized.
Figure 20:
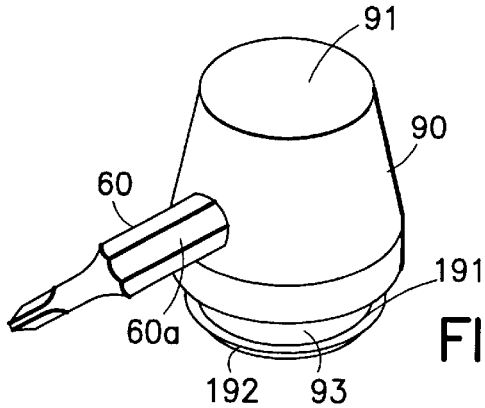
FIG. 20 is a perspective view of the handle cap of FIG. 19 with a tool bit being magnetized.
Figure 21:
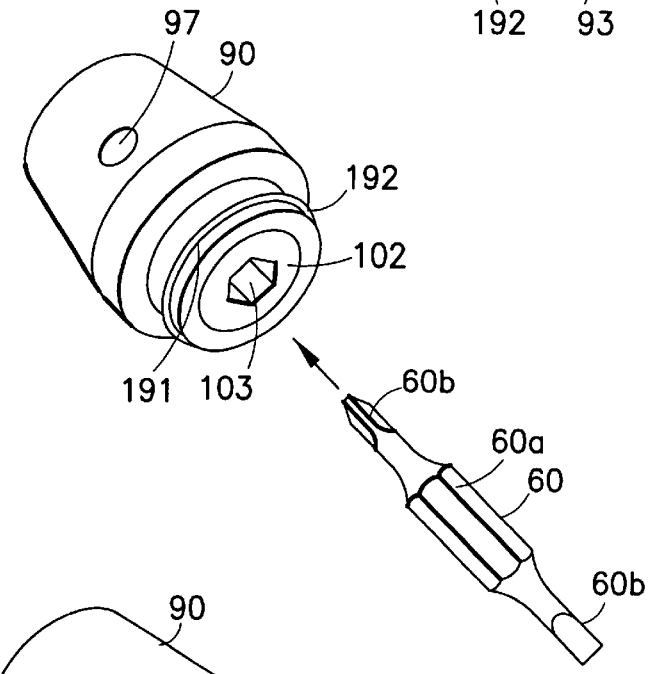
FIG. 21 is a perspective view of the handle cap of FIG. 19 showing insertion of the tool bit.
Figure 22:
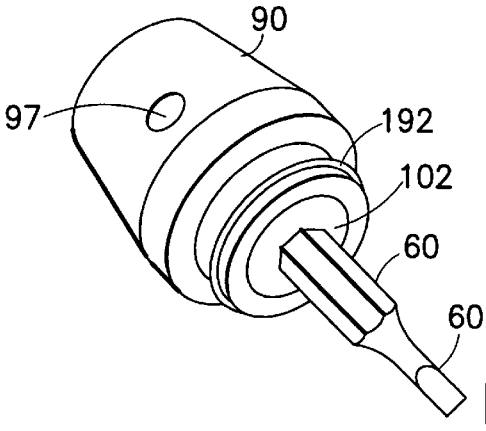
FIG. 22 is a perspective view of the handle cap of FIG. 19 with the tool bit inserted.

Cap cross-hole 97 is sized to slidably receive a selected tool bit 60 so that tool bit 60 is magnetized by magnet 100 (FIG. 20). The magnetized tool bit can then be mounted in distal recess 75 whereat the operably disposed magnetized tool bit end can hold a screw or like ferro-metallic drive element (not shown). A further feature of the present tool is that by striking a magnetized tool bit across cap proximate shallow recessed surface 91, the tool bit becomes demagnetized (FIG. 19).

Magnet 100 is a rare earth magnet as shown and described in U.S. Pat. No. 6,181,229, U.S. Pat. No. 5,794,497, U.S. Pat. No. 6,026,717 and U.S. Pat. No. 6,026,718, which patent disclosures are incorporated herein by reference thereto. Magnet 100 has an energy product of at least about $6.0\times10^6$ gauss-oersteds, and preferably at least about $7.0\times10^6$ gauss-oersteds.

Figure 16:
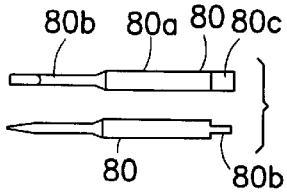
FIG.16 PRIOR ART
FIG. 16 is a respective side elevational and top plan view of a prior art single-ended precision tool bit.
Figure 17:
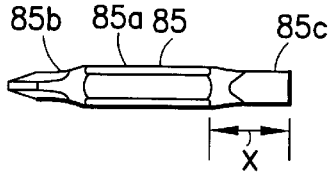
FIG.17 PRIOR ART
FIG. 17 is a side elevational view of a prior art non-precision double-ended tool bit.
Figure 18:
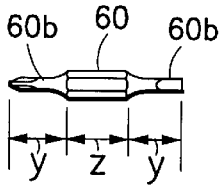
FIG. 18 is a side elevational view of the precision double-ended tool bit of the present invention.

Referring to FIGS. 16–18 there is shown, respectively, side and top views of a typical prior art precision tool bit 80 (FIG. 16), a side elevational view of a typical prior art non-precision double-ended tool bit 85 (FIG. 17), and the double-ended precision tool bit 60 of the present invention (FIG. 13). FIGS. 11–13 are shown in accurate proportional scale for size and configuration comparisons. Tool bit 80 is generally formed of cylindrical wire stock and includes an elongated body portion 80*a* and an elongated single bit end 80*b* and proximate end ears 80*c* for locking the bit in the tool (not shown in FIG. 11, but generally shown in FIGS. 4A and 4B). It was generally believed and the direction of the prior art that only a single bit could be accurately minimal for a precision tool, as generally shown in FIGS. 1–4B. Referring now to FIG. 12, conventional double-end tool bit 85 has a body portion 85*a* and a first bit end 85*b* and second bit end 85*c*. Tool bit end lengths x were generally at least about ½ inch or 17 mm, with the distance across the body flats being generally at least about ¼ inch or 8.5 mm. The art was directed to a tool bit length of at least about 17 mm for an accurately mechanical hex bar stock of about 8.5 mm in construction. The precision tool bit 60 of the present invention, as shown in FIG. 18, has a body portion of regular hexagonal cross-section with a width of no more than about 4 mm across the flat sides of the regular hexagon, and a body length y of no more than about 8–10 mm, with a tool bit 60*b* integrally formed at respective opposite ends of the body portion. Each tool bit 60*b* length z is no more than about ⅜ inch or about 8–10 mm. That is, the present invention has found that it is practical to production machine bar stock of 4 mm and produce precision bit ends having bit end lengths of 8–10 mm and a body length of 8–10 mm, or an overall length of 24–30 mm. The aforedescribed tool bit and the handle construction provides a practical multiple-in-1 precision tool. Tool bit ends 60*b* maybe of different drive sizes and/or configurations. It is within the contemplation of the present invention to provide different drive configurations such as flat blade screwdriver, Phillips, and TORX configurations, by way of example.

In the aforesaid manner of construction, the user in one mode of use, grasps the handle body with the thumb and middle fingers and places the end of the index finger in the proximate end recess of the handle cap for fine precision use, as shown in FIGS. 14 and 15. Handle cap swivels within handle body proximate recess to further contribute to fine control precision grip use.

There is provided by the present invention a versatile multiple-in-1 pocket precision drive tool, namely a 12-in-1 pocket precision drive tool and a 12-in-1 stubby or mini handle cap precision drive tool. The present tool provides mag/demag functionality as well as multiple nut drive functionality. This most versatile multiple use construction is readily and practically stowed and within a shirt pocket. The clear plastic construction of the first handle body portion permits the user to identify the desired stowed precision tool bit.

Although the present invention has been described in some detail by the way of illustration and example for purposes of clarity and understanding, it will of course be understood that various changes and modifications may be made in the form, details and arrangements of the elements and parts without departing from the scope of the invention as set forth in the adjoined claims.

What is claimed is:

1. A precision hand tool comprising;

precision tool bit members, each member having a body and oppositely disposed ends and having a tool bit disposed at each said end;

a handle, said handle having a proximate end and a distal end, and having elongated compartments to receive said precision tool bit members for storage within the compartments;

further comprising a handle cap, said handle cap comprising means for removably rotatably attaching the handle cap to the handle proximate end to cover the compartments with the tool bit members in a closed position, said handle cap being rotatable in the closed position; and a shank, said shank having a proximate end and a distal end, and means for connecting said shank proximate end to said handle distal end, said shank distal end comprising means for slidably receiving a selected tool bit member so that one tool bit is operably disposed.

2. The precision hand tool of claim 1, said handle cap being formed with a centrally disposed recess for slidably receiving one tool bit member.

3. The precision hand tool of claim 2, said handle cap further comprising a permanent magnet operably disposed with respect to the handle cap recess to magnetically hold the slidably received one tool bit member, whereby the slidably received tool bit member is magnetized and operably held in the handle cap.

4. The precision hand tool of claim 3, wherein the magnet has en energy product of at least about $6.0\times10^6$ gauss-oersteds.

5. The precision hand tool of claim 4, said handle cap defining a first position for receiving the magnetized one tool bit member to demagnetize the one tool bit member.

6. The precision hand tool of claim 1, said handle comprising means for retractably extending said shank to a desired length.

7. The precision hand tool of claim 1, said compartments comprising radially disposed wedge shaped compartments.

8. The precision hand tool of claim 2, said handle further comprising a central elongated compartment in coaxial alignment with said handle cap recess.

9. The precision hand tool of claim 1, said handle cap having a permanent magnet, and said handle cap defining a first position for magnetizing a selected tool bit and a second position spacedly disposed from the first position for demagnetizing the selected tool bit.

10. A multiple-in-1 precision tool comprising:

a handle, said handle having a proximate end and a distal end, and being formed with a central compartment and a plurality radially disposed compartments adjacent the proximate end for storing tool bits, a handle cap, said handle cap having a distal end having a central compartment, and means for removably rotatably attaching said handle cap distal end to said handle proximate end to cover the radially disposed compartments with the tool bits in a closed position, said handle cap being rotatable in the closed position, whereby the central compartments are in communication, a shank, said shank having a proximate end and a distal, and having a sleeve disposed at the shank distal end, and means for slidably extending said shank in said handle, interchangeable precision tool bits, each said handle compartment, said handle cap compartment being formed to slidably receive at least one tool bit, whereby with a tool bit disposed in the handle cap and the handle cap removed from the handle there is a mini multiple-in-1 precision drive tool and with the handle cap attached and a tool bit disposed in the sleeve there is a multiple-in-1 precision drive tool.

11. The precision tool claim 10, said handle further comprising means for selectively extending said shank from said handle to a desired length.

12. The precision tool of claim 10, said handle comprising a plurality of flat surfaces and arcuate surfaces for finger and thumb engagement for precision tool bit drive use.

13. The precision tool of claim 10, said shank having a polygonal cross section, and said handle distal end being formed with a polygonal recess for slidable engagement of said shank.

14. The precision tool of claim 10, said shank proximate end and said handle distal end being cooperatively formed with stop means to limit the extension of the shank.

15. The precision tool of claim 10, said shank proximate end and said handle distal end comprising means for distributing forces caused by flexure of the shank when extended.

16. The precision tool of claim 15, said means for distributing forces comprising a portion of the shank distal end disposed in a portion of the handle distal end.

17. The precision tool of claim 10, said shank comprising metal construction and said handle comprising plastic construction.

18. The precision tool of claim 10, said handle proximate end comprising a first plurality of flat surfaces and adjacent arcuate surfaces, said surfaces having about the same surface area for selective diverse finger and thumb engagement, and further comprising a plurality of handle distal end flat surfaces, said distal end flat surfaces being tapered towards the handle distal end.

19. The precision tool of claim 10, wherein the handle cap distal end is contoured for receiving the end of an index finger for precision tool bit drive use.

20. The precision tool of claim 10, said handle proximate end comprising a first plurality of flat surfaces and adjacent arcuate surfaces, said surfaces having about the same surface area for selective diverse finger and thumb engagement.

21. A precision multiple-in-1 pocket tool comprising:

a handle having a proximate end and a distal end, a handle cap removably rotatably attached to the handle proximate end, a shank having a proximate end disposed in the distal end of the handle and being extendable from the handle distal end, a sleeve disposed at the distal end of the shank, precision tool bit members, one said tool bit member being operably disposable in said shank sleeve, said handle cap having means for holding one tool bit member, and said handle being formed with elongated compartments for stowing a plurality of said tool bit members, each tool bit member comprising a body and oppositely disposed precision tool bits, wherein the length of each tool bit is about equal to the length of the member body, said handle cap covers the handle compartments with the stowed tool bit members in a closed position, and said handle cap being rotatable in the closed position.

22. The precision pocket tool of claim 21, each said tool bit length and said body length being about 8–10 mm.

23. The precision pocket tool of claim 21, said handle cap further comprising means for holding the tool bit member comprising a permanent rare earth metal magnet.

24. The precision pocket tool of claim 21, said handle comprising a proximately dispersed polygonal portion and a distally designed polygonal portion and wherein the distally dispersed polygonal portion is tapered in the distal direction.

25. The precision pocket tool of claim 21, said handle cap being of fustro-conical construction, said handle cap having a proximate end formed to receive the end of a forefinger.

26. The precision pocket tool of claim 21, further comprising a pocket clip disposed on said handle adjacent said handle cap.

27. The precision pocket tool of claim 21, said member body being hexagonal and having a cross dimension of about 4 mm and a length of about 8–10 mm, whereby the length of the tool bit member is about 24–30 mm.

28. The precision pocket tool of claim 21, said handle comprising a proximately disposed polygonal portion, and a distally tapered polygonal portion, said member body being hexagonal and having a cross dimension of about 4 mm and a length of about 8–10 mm, and the length of the tool bit member is about 24–30 mm, and wherein four tool bit members are stowed within the proximate polygonal portion and not the distal polygonal portion.

* * * * *